United States Patent [19]

Bass et al.

[11] 4,100,867

[45] Jul. 18, 1978

[54] SEWING MACHINE

[75] Inventors: Sidney Bass, Los Angeles; Hubert Allen Rich, Westminster, both of Calif.

[73] Assignee: Mattel, Inc., Hawthorne, Calif.

[21] Appl. No.: 761,381

[22] Filed: Jan. 21, 1977

[51] Int. Cl.[2] ..... D05B 55/00; D05B 69/22

[52] U.S. Cl. ..... 112/270; 112/221; 112/275

[58] Field of Search ..... 112/270, 274, 275, 221, 112/197, 258, 259, 302; 242/137, 137.1, 138, 71.1, 55.19 A

[56] References Cited

U.S. PATENT DOCUMENTS

| | | | |
|---|---|---|---|
| 3,385,247 | 5/1968 | Johnson et al. | 112/270 |
| 3,667,412 | 6/1972 | Perla | 112/275 |
| 3,749,039 | 7/1973 | Fritts | 112/302 |

*Primary Examiner*—Peter Nerbun

*Attorney, Agent, or Firm*—John G. Mesaros; Max E. Shirk; Stephen L. King

[57] ABSTRACT

An electrically operated chain stitch sewing maching having a cartridge carrying a spool of thread and a pre-threaded needle mounted in the side of the head, the needle being normally biased in a retracted position within the cartridge and being actuated by a crank arm provided with means for rendering an electrical switch inoperative until the needle is retracted into the cartridge. The bed of the machine is provided with a thread looping subassembly actuated by the needle.

12 Claims, 16 Drawing Figures

14
44
46
42
28
54
52
49
56
54
60
50
36
38
40
34
66
16
32
66
10
68
74
72
76
78
172
168
26
204
80
86
82
98
92
88
90
96
18
22
84
24
94

FIG. 8
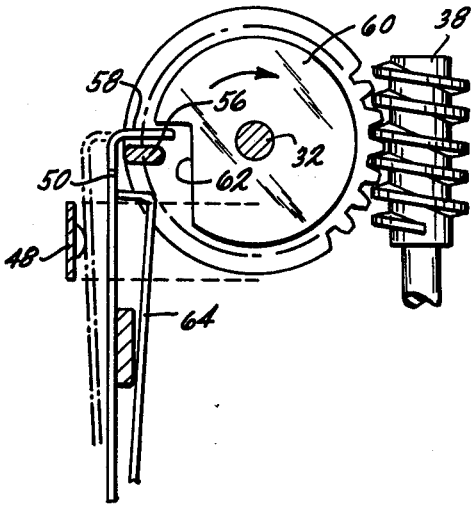
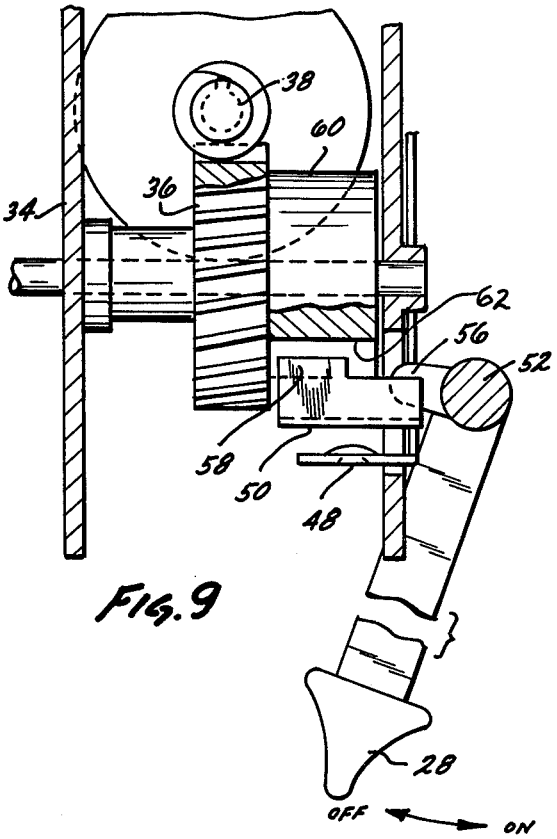
FIG. 9
FIG. 7
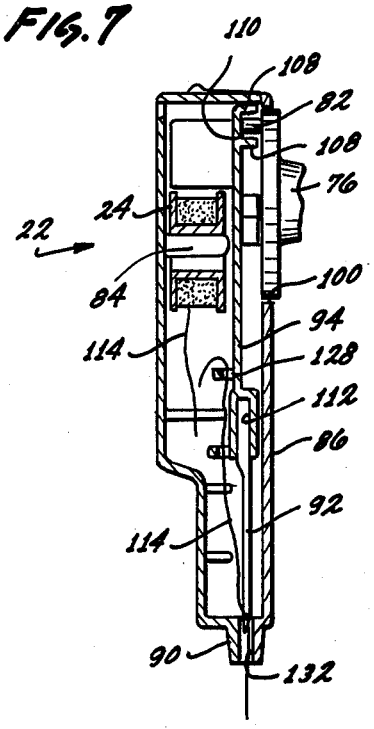
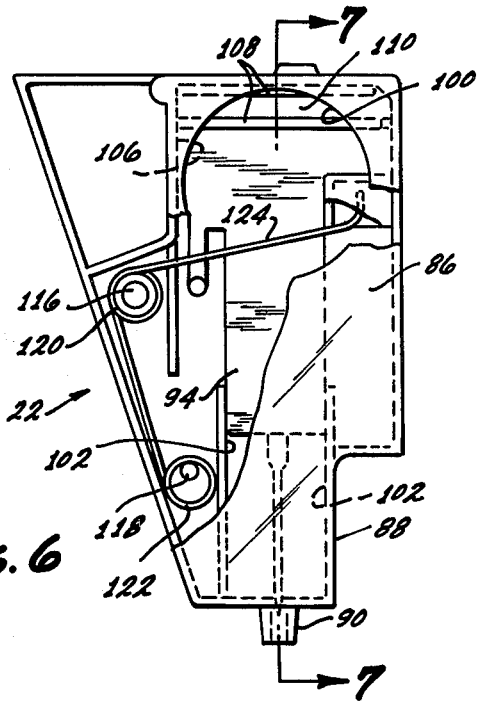
FIG. 6

SEWING MACHINE

CROSS-REFERENCE TO RELATED APPLICATION

This patent application is related to a patent application filed concurrently herewith, and assigned to the assignee of the instant invention, such related patent application being entitled "Cartridge Sewing Machine Accessory" by SIDNEY (NMI) BASS, HUBERT ALLEN RICH AND HERBERT (NMI) MAY.

BACKGROUND OF THE INVENTION

The background of the invention will be discussed in two parts:

1. Field of the Invention

This invention relates to sewing machines and more particularly to an electrically operated chain stitch sewing machine.

2. Description of the Prior Art

Sewing machines utilizing a single spool of thread for making chain stitches through fabric are well known in the prior art. One such sewing machine, which is hand-operated, is shown in reissue Pat. No. 599 dated Sept. 14, 1858 and titled "Sewing Machine" T. J. W. Robertson. In this patent, the needle actuates a slider which carries the looper which is operated in a diagonal direction to the line of feed to open the loop of thread and keep it in position for the needle to pass through.

Another chain stitch sewing machine is shown in U.S. Pat. No. 21,833 entitled "Sewing Machine" issued Oct. 19, 1858 to G. W. Hubbard. In this patent, the looping hook is operated by a fixture attached to the needle-bar, the fixture including a pin adapted to pierce the cloth along with the needle, the pin driving a piston to throw open the looper.

Another such sewing machine is shown in U.S. Pat. No. 19,535 issued Mar. 2, 1858 to A. W. Sangster entitled "Sewing Machine", in which the point of the needle pushes a plunger downward to actuate the looper to create the chain stitch.

Sewing machines utilizing cartridges or cassettes for carrying a spool of thread or a spool of thread and a needle are shown in U.S. Pat. No. 3,385,247 entitled "Sewing Machines" issued May 28, 1968 to Johnson, et al., and U.S. Pat. No. 3,749,039 issued July 31, 1973 to Fritts entitled "Cassette Threading Arrangement in Sewing Machines". In U.S. Pat. No. 3,385,247 the cartridge unit has a hollow needle integral with the cartridge housing, the cartridge unit, in its entirety, being reciprocated during the sewing operation. U.S. Pat. No. 3,749,039 discloses a cassette arrangement containing the spool of thread along with a thread tensioning device, a check spring and a thread takeup member, the cassette then being inserted into the machine.

Other prior art known to applicant is listed by way of illustration, and not of limitation, in a separate communication to the Patent Office.

It is an object of the present invention to provide a cartridge for a sewing machine in which the needle reciprocates within the cartridge.

It is another object of this invention to provide a new and improved sewing machine which accomplishes a chain stitch in fabrics with a minimum number of movable parts in an uncomplicated arrangement.

It is a further object of the invention to provide means for switching off the electrical circuit for the driving motor only when the needle is fully retracted within the cardtridge.

SUMMARY OF THE INVENTION

The foregoing and other objects of the invention are accomplished by providing an electrically operated chain stitch sewing machine having a cartridge mounted in the side of the head, the cartridge containing therein a spool of thread and a pre-threaded needle on a needle carrier adapted for reciprocation within the cartridge. The thread looping is accomplished by a member pivotally actuated by the needle and laterally displaced during pivoting to loop the thread carried by the needle. The needle carrier is normally biased upwardly within the cartridge with the needle in a retracted position, the needle carrier coacting with a crank pin on a crank arm inside the machine. The crank arm coacts with the electrical switch, the crank arm having a disc coacting with the switch, the disc being detented at a position corresponding to the fully retracted needle position so that the switch arm coacting with the disc can be returned to its normally biased open position only when the switch arm engages the switch detent.

Other objects, features and advantages of the invention will become apparent upon a reading of the specification when taken in conjunction with the drawings in which like referenced characters refer to like elements.

BRIEF DESCRIPTION OF THE DRAWINGS

FIG. 6 is a rear view of the cartridge used in the sewing machine of FIG. 1;

FIG. 7 is a cross-sectional view of the cartridge taken along line 7—7 of FIG. 6;

FIG. 8 is an enlarged partial end view of the switch and switch disc mechanism utilized in the sewing machine of FIG. 1;

FIG. 9 is an enlarged partial top view of the switch and switch disc mechanism illustrated in FIG. 8 showing the switch lever and motor;

DESCRIPTION OF THE PREFERRED EMBODIMENT

Figure 1:
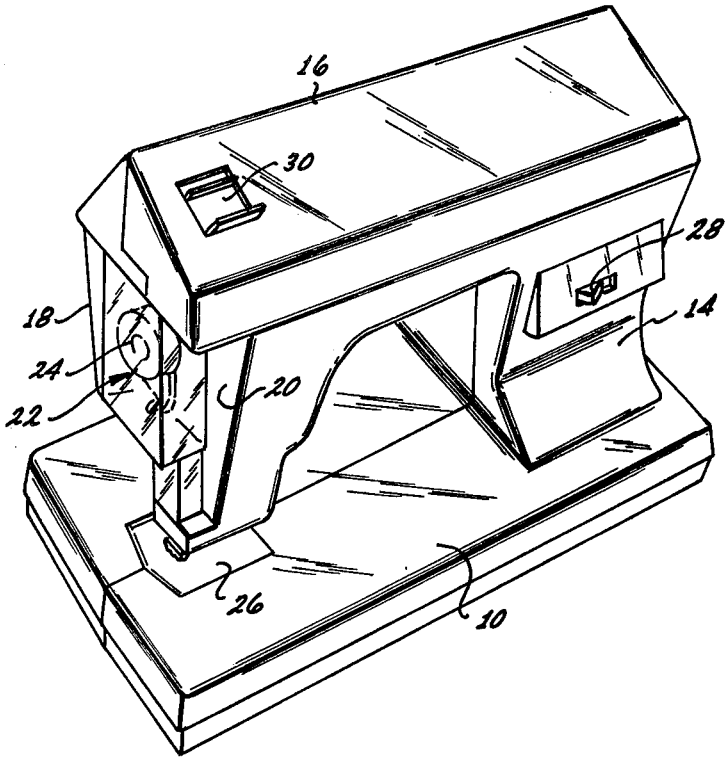
FIG. 1 is a perspective view of a sewing machine according to the invention.

Referring now to the drawings and particularly to FIG. 1 there is shown a sewing machine including a main platform or work-supporting bed 10 having an integral upwardly extending standard 14, a bracket arm 16 extending generally parallel to the bed 10 from the standard 14, the other end of which terminates in a head 18. The head 18 is provided with a recessed surface 20 which is adapted to frictionally receive and retain a cartridge 22 which contains a spool of thread 24 and a needle carrier as will hereinafter be discussed. The bed 10 immediately beneath the cartridge 22 is provided with a thread looping subassembly or module, generally designated 26, having an aperture therein in alignment with the needle carried within cartridge 22. The sewing machine depicted in FIG. 1, although primarily intended for use by children, can also be used as an auxilliary sewing machine, but in any event it is electrically operated with the motor electrically connected in conventional fashion and actuated by a switch 28 located in standard 14 and actuable in the horizontal direction to energize the motor contained therein. Located in the broad surface of the bracket arm 16 is a material advance foot lift lever 30, the purpose of which will be discussed. The spacing between the cartridge 22 and thread looping module 26 is minimal to allow the insertion of the fabric to be sewn but not permit insertion of fingers into proximity to the needle within the cartridge 22. As constructed, the sewing machine will sew a chain stitch in fabric, the chain stitch being that type of sewing stitch which only requires one spool of thread as opposed to conventional sewing machines currently popular which utilize a spool of thread positioned on the bracket arm for coacting with a needle to pass through the fabric, and a second spool of thread located on a bobbin beneath the bed. In a chain stitch the thread is looped after it passes through the fabric, this loop is retained beneath the fabric as the fabric advances a stitch length, and a descending needle passing through the fabric a second time passes through the loop which is then released as the looping mechanism grasps the thread now passing through the fabric to create a subsequent loop.

Figure 2:
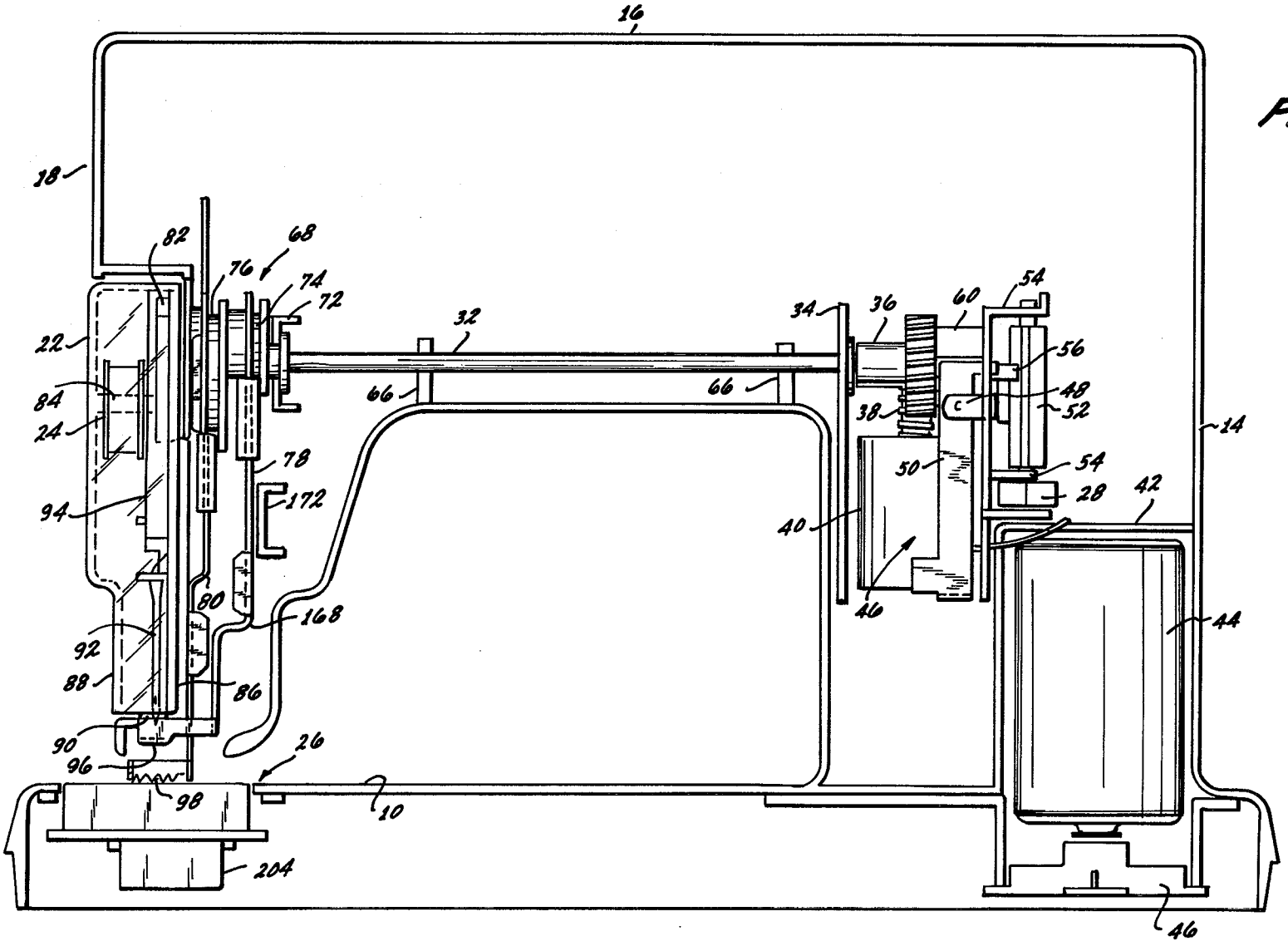
FIG. 2 is a front view of the sewing machine of FIG. 1 with the front half of the housing thereof removed.

Referring now to FIGS. 2 through 5 the inner construction of the sewing machine will be described. The main housing for the sewing machine is hollow and formed from two half housings, these being a front housing and a rear housing and in FIG. 2 the front housing has been removed. The standard 14 contains the main electrical components of the machine while the head 18 contains the operating components interconnected by a shaft 32 extending through the hollow bracket arm 16. Suitably mounted within the standard 14 is a motor housing 34 which rotatably supports shaft 32 which has secured to one end thereof a gear 36 coacting with a worm 38 secured to the shaft of motor 40. The lower right-hand portion of standard 14 is configured to provide a battery housing 42 into which is inserted two "D" size batteries 44 (only one of which is shown). The batteries are retained within battery housing 42 by means of a suitable cover 46 accessible through the open bottom of bed 10. The cover 46 is locked in conventional fashion and electrical contact strips are provided within battery housing 42 to connect the batteries with proper polarity to energize the motor 40. In series between the motor 40 and battery 44 is a suitable switch, generally designated 46, which includes a stationary contact member 48 and a movable switch arm 50 which is secured to the motor housing 34 at its lower end and is normally biased away from stationary contact 48 (see also FIGS. 8 and 9). A switch lever 52 is pivotally supported on a vertical axis to motor housing 34 by mens of suitable bearing projections 54 extending out from the side surface thereof, the switch arm 50 having a transversely extending section extending outwardly of the housing to form the enlarged portion of switch 28. Integral with switch lever 52 is an actuating projection 56 which is adapted to engage the inner surface of switch arm 50 to urge it against its normal bias into contact with stationary contact 48 to thereby complete a series circuit between motor 40 and battery 44. As better illustrated in FIGS. 8 and 9 the switch arm 50 has a bent portion 58 extending toward shaft 32 and gear 36 has an integral switch disc portion 60 adapted for rotation therewith about shaft 32, the switch disc 60 having a switch detent 62 configured for matingly coacting with the bent portion 58 of switch arm 50. As shown in FIG. 8 the switch arm 50 is movable from the solid line or "off" position to the dotted line or "on" position by means of the actuating projection 56 of switch lever 52 when switch knob 28 is moved. The diameter of switch disc 60 is such that it freely clears the outer end of bent portion 58 of switch arm 50 when the switch arm 50 is deflected to its dotted line position thereby "closing" the electrical circuit and energizing the motor 40. The switch disc 60 along with, of course, shaft 32, rotates in the direction indicated by the arrow on disc 60. If the switch lever 52 is rotated to its "off" position, the actuating projection 56 will have the position indicated in cross section in FIG. 8. If, at this point in time the circumference of switch disc 60 is in the path of the bent portion 58 of switch arm 50 the free end of bent portion 58 will engage the circumference of switch disc 60 and switch arm 50 will remain in its dotted line position, thereby maintaining a closed electrical circuit between the stationary electrical contact 48 and the conductive switch arm 50. At such time as the notched out portion of detent 62 passes the bent portion 58 of switch arm 50, the switch arm 50 will return to its solid line position thereby disconnecting the electrical circuit. A resilient stop member 64 is provided inwardly of switch arm 50 to limit the distance of travel of switch arm 50 from its dotted line to its solid line position. As will hereinafter be discussed, the switch detent 62 is so positioned with respect to shaft 32 that with the switch disc 60 in the position shown in FIG. 8, the needle within cartridge 22 will be fully retracted, thereby permitting deenergization of motor 40 only after the needle has been fully retracted into the cartridge 22, despite the timing of movement of switch 28 by an operator. As illustrated in FIGS. 2 and 9, the width of switch disc 60 is sufficiently wide to provide a broad bearing surface against which the leading edge of bent portion 58 rides during the interval of time required.

Referring again to FIG. 2, the motor housing 34 is suitably secured within standard 14 and shaft 32 is suitably supported by means of integral support webs 66 formed on the interior of bracket arm 16. The other end of shaft 32 has secured thereto a suitable cam member generally designated 68 which has an integral bearing portion rotatably supported within a bearing aperture 72 formed integrally on the interior of bracket arm 16. The cam member 68, shaft 32 and gear member 36 form a crank arm for controlling movement of all operative members within the housing. The cam member 68 has first and second cam portions 74 and 76 respectively, cam surface or portion 74 being adapted to receive a pressure foot member 78 while cam portion 76 is configured to receive and operate an advance foot member 80. The pressure foot member 78 and advance foot member 80 are adapted to reciprocate on a vertical line in conjunction with the needle under operation of cam member 68. The cam member 68 terminates at the outer end thereof in a circular surface having extending outwardly therefrom a driving member or crank pin 82 which coacts with the interior of cartridge 22 to operate the needle.

Generally, as can be seen in FIG. 2, the cartridge 22 has a transparent housing with an inwardly extending projection 84 which rotatably receives spool 24. The cartridge 22 is provided with a generally planar surface 86 which abuts against recess surface 20 formed in head 18. The lower portion of cartridge 22 is inwardly stepped at 88 and at the lower end thereof is provided with a neck 90 having a centrally disposed aperture through which needle 92 passes upon reciprocal movement of needle carrier 94 under influence of crank pin 82 upon rotation of shaft 32 when the motor 40 is energized. The needle 92 operates on a given line to pass downwardly through an aperture within pressure foot 96 of pressure foot member 78 through the opening in advance foot 98 of advance foot member 80 through an aperture into thread looping module 26.

Referring to FIGS. 2, 3, 6 and 7 the details pertaining to the construction of the cartridge 22 will be discussed. As previously mentioned the cartridge 22 has a hollow transparent housing with a generally planar rear surface 86 having an enlarged aperture 100 therein, the aperture 100 being adapted to receive the outer disc portion of cam member 68 with crank pin 82 extending through aperture 100 to the interior of cartridge 22. Slidably positioned adjacent the rear surface 86 within cartridge 22 is needle carrier 94 which is retained in sliding relation therewith by means of suitable guide surfaces 102 formed integrally within the stepped portion 88 of cartridge 22. The needle carrier 94 is generally T-shaped with the crossbar portion 104 being configured to slidably abut opposing parallel sidewalls 106 of the upper part of cartridge 22 thereby providing additional support for needle carrier 94 during its vertical movement. Formed integrally in the rear surface of crossbar portion 104 is a pair of spaced ribs 108 which define a crank pin groove 110 which receives crank pin 82 for converting the rotary motion of crank pin into reciprocating motion of needle carrier 94. The needle 92 is securely fixed as by press fitting within a recess 112 formed integrally in the bottom of needle carrier 94. The needle 92 is of conventional configuration having an eye adjacent the point thereof for passage therethrough of thread 114. Formed on the interior surface of cartridge 22 are suitable integral bosses 116 and 118, the bosses 116 and 118 containing the coiled portions 120 and 122 respectively of a wire spring member 124 having the free end thereof normally biased upwardly and suitably engaging needle carrier 94 to thereby bias needle carrier 94 in the position shown in FIG. 3. The wire spring 124 serves a dual purpose, one purpose being to bias the needle carrier 94 upwardly as previously discussed and the second purpose being to assist in establishing thread tension by means of coil 122 coacting with boss 118. As previously mentioned, the cartridge 22 is pre-loaded with a full spool 24 of thread and a pre-threaded needle 92, the thread 114 passing from the spool 24 through an eyelet 126 affixed within an aperture within one of the interior guide surfaces 102, the thread 114 then encircling boss 118 between coil 122 and the adjacent surface of cartridge 22. The spacing between coil 122 and the adjacent surface is such that it is only slightly larger than the diameter of the thread 114 which is then reversed in direction to pass again through eyelet 126 through an opening 128 formed integrally in needle carrier 94 immediately above recess 112, the thread 114 then being passed through the eye 130 of needle 92 thence out through aperture 132 formed in the cartridge neck 90 for grasping by the operator of the sewing machine.

Figure 3:
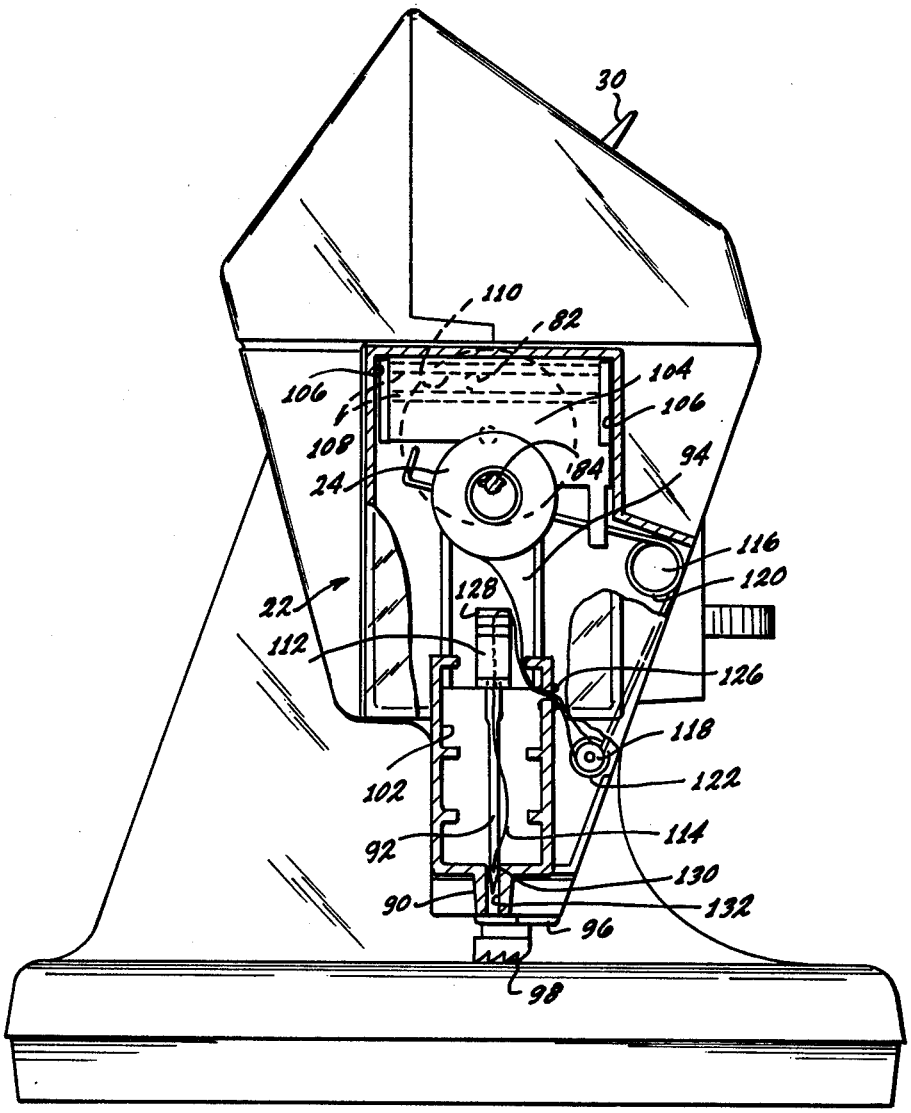
FIG. 3 is an end view of the sewing machine of FIG. 1, partially in cross section and partially broken away, showing the cartridge inner details.

As can be seen in FIGS. 3 and 7 with the needle carrier 94 in its fully raised position, that is in its upper position under the normal biasing force of wire spring 124, the needle 92 is fully retracted within the cartridge 22 and the position of crank pin 82 with respect to crank pin groove 110 corresponds to the position of switch disc 60 shown in FIG. 8 with respect to the solid line position of switch arm 50 engaging switch detent 62. As a consequence, with the position of crank pin 82 being fixed with respect to switch detent 62 the previously discussed situation exists, that is, notwithstanding the movement of switch knob 28 to the "off" position the motor will not be de-energized until the bent portion 58 of switch arm 50 fits within switch detent 62 thereby resulting in crank pin 82 being in its uppermost position along with needle carrier 94 resulting in needle 92 being fully retracted within cartridge 22.

Figure 4:
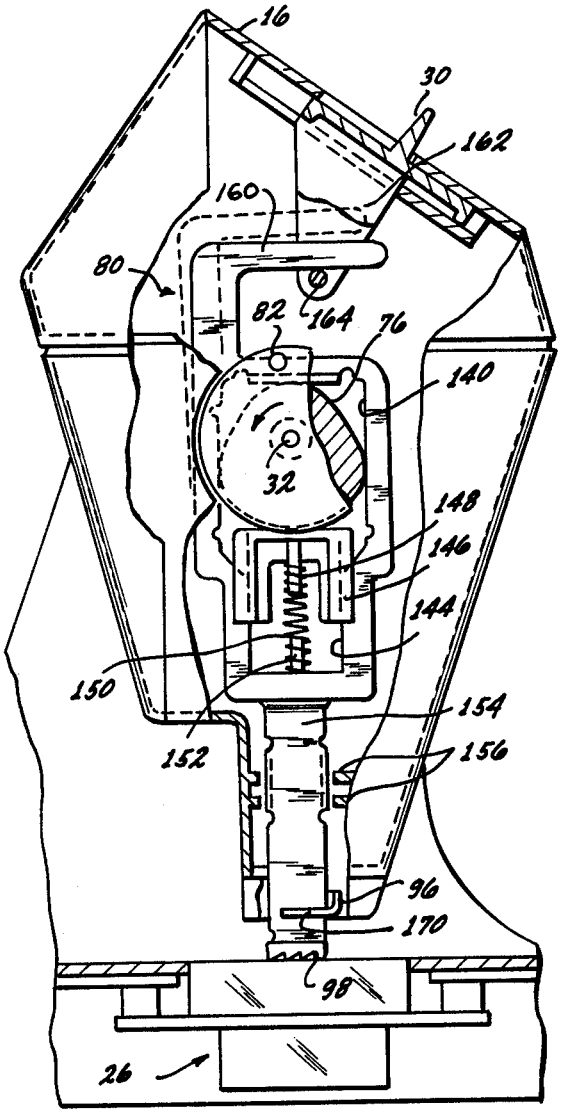
FIG. 4 is an end view similar to FIG. 3 with the cartridge removed and partially in cross section and partially broken away to illustrate the advance foot construction.

Referring now to FIGS. 2–5 the details pertaining to the advance foot member 80 and pressure foot member 78 will be discussed. As best illustrated in FIG. 4, the advance foot member, generally designated 80, has a first piece which may be made from a metal stamping or the like, the first piece being configured to provide an enlarged rectangular opening 140 having portions about the periphery thereof bent transversely to the opening 140 to provide a broad bearing surface adapted to receive and coact with cam surface 76 of cam member 68, the cam surface 76 being generally triangular with arcuate surfaces rotating eccentrically about the shaft 32 within opening 140. The opening 140 has the lower end thereof stepped inwardly to provide a guide opening 144 configured to receive a slider 146 which is grooved adjacent opposite edges thereof to be slidably inserted within guide opening 144. Centrally disposed and downwardly depending from slider 146 is a projection 148 receiving one end of a bias spring 150, the other end of coil bias spring 150 encircling an upwardly extending aligned projection 152 formed integrally with advance foot member 80. The slider 146 has a width adapted for abuttingly engaging the cam surface 76 during rotation of cam member 68 to thereby urge opening 140 of advance foot member 80 into contact with the cam surface 76. The lower portion 154 of advance foot member 80 is generally bar-shaped and extends downwardly through head 18 where it terminates in a transversely extending U-shaped foot 98 having serrations on the lower edge thereof for feeding the material over the work bed 10. The lower bar portion 154 of advance foot member 80 is suitably guided in its vertical direction of travel by means of guide ribs 156 formed integrally on the interior surface of head 18, the guide ribs 156 being positioned on either side of bar portion 154 with bar portion 154 being suitably bent adjacent thereto for providing a broad bearing surface against guide ribs 156.

The upper end of advance foot member 80 is provided with a lift arm 160 which has an upwardly extending portion and a horizontal arm fitting between a bifurcated flange 162 integral with and downwardly depending from advance foot lift member 30. The lift arm 160 is maintained between opposing surfaces of bifurcated flange 162 by means of a suitable fastener or pin 164 which passes horizontally through both flange portions to retain lift arm 160 thereabove. The advance foot lift member 30 is slidably retained on a diagonal surface of bracket arm 16 so that movement of member 30 upwardly causes pin 164 to move laterally to the left as viewed in FIG. 4 as well as upwardly to pull lift arm 160 in a vertical direction thereby raising advance foot 98 from engagement with the upper surface of thread looping module 26 which is co-planar with the work bed 10. This movement is effected against the force of coil spring 150 interposed between slider 146 and the lower edge of guide opening 144. After the material is inserted beneath advance foot 98, the member 30 is then slid downwardly until advance foot member 80 is in the position indicated in FIG. 4 in solid lines. By configuring lift arm 160 with the free end thereof passing through the bifurcated flange 162 the advance foot lift mechanism is uncomplicated and permits freedom of movement of advance foot member 80 during rotation of cam member 68 along with, of course, cam surface 76.

Figure 5:
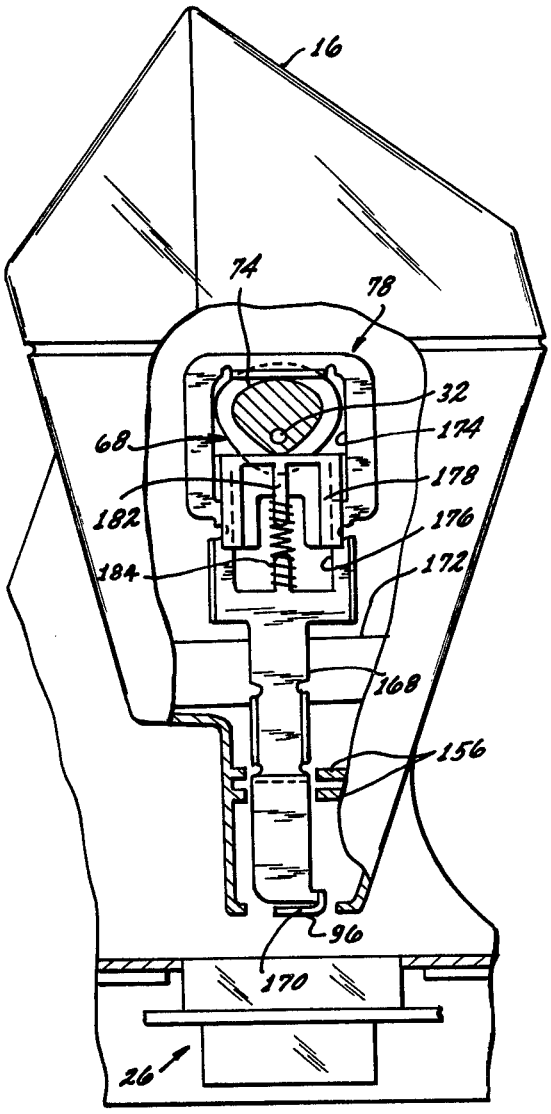
FIG. 5 is an end view similar to FIG. 4, partially in cross section and partially broken away, with the advance foot removed to show the pressure foot construction.

Referring to FIGS. 4 and 5 the cam surface 76 and cam surface 78 are shown in exact relation to each other at any given point in time and the direction of rotation of the cam surfaces is shown by the arrow on cam surface 76 in FIG. 4. The cam surface 76 is generally ovate to provide a large eccentric movement of advance foot member 80 along both a vertical line as well as a horizontal line thereby lifting as well as rocking advance foot member 80. The rocking action is accomplished by means of the bar portion 154 of advance foot member 80 pivoting with respect to guide ribs 156. The maximum distance of upward travel of advance foot member 80 is determined by the maximum diameter of cam surface 76, this maximum distance being between the shaft 32 downwardly to the portion of cam surface 76 coacting with slider 146.

By comparing the dimensions of FIG. 4 with those of FIG. 5 which are equal in scale, the cam surface 74, while similarly ovate, has a smaller distance of vertical travel, the cam surface 74 being configured to generate generally vertical reciprocating movement of pressure foot member 78 with the downward distance of travel being defined by pressure foot 96 abutting against the surface of bed 10 under pressure. Pressure foot 96 and advance foot 98 are so configured as not to interfere with each other during the reciprocating movement of the respective parts.

The advance foot member 80 has the upper portion thereof moving vertically to the dotted line position as well as laterally to the dotted lines on either side thereof resulting in a lifting and rocking motion. The advance foot member 80, the pressure foot member 78 and the needle 92 are in mechanically phased operation to accomplish the following: maintain the fabric in position; permit the needle to penetrate the fabric; remove the needle from the fabric while maintaining pressure on the fabric; increment the fabric; re-grip the fabric and permit re-insertion of the needle.

Referring to FIGS. 2 and 5 the details relating to the pressure foot member 78 will be described. The pressure foot member 78 is configured to operate in conjunction with advance foot member 80 and to reciprocate on a vertical line generally parallel to the line of movement of needle 92 in phased relation therewith and with advance foot member 80. This phased relation is accomplished by the cam surface 68 being one-piece and having the advance foot cam surface 76 and pressure foot cam surface 74 properly configured and properly phased with respect to crank pin 82. As shown in FIG. 2 the lower part 168 of pressure foot member 78 is generally bar-shaped and is bent inwardly and then downwardly to be in spaced proximate relation with bar portion 154 of advance foot member 80. The lower edge of the bar part 168 is configured to form the pressure foot 96 which extends generally parallel to the bed 10 and has the free end thereof configured to form a fork 170 in the form of a generally V-shaped notch, the fork 170 being so aligned with respect to needle 92 for passage of needle 92 through the opening of fork 170. Pressure foot 96 is adapted to pass through the U-shaped advance foot 98 during reciprocation of the parts. In addition to providing suitable guiding by means of guide ribs 156, the interior of head 18 is also provided with a suitable guide surface 172 in proximity to the broad surface of bar portion 168 of pressure foot member 78 to assist in the maintenance of the vertical travel required of pressure foot member 78.

As better illustrated in FIG. 5, the upper part of pressure foot member 78 has an enlarged rectangular cam surface receiving opening 174 having bent portions about the periphery thereof to provide a broad cam engaging surface for abutting against cam surface 74 during rotation within opening 174. Similarly, as with the opening 140 of advance foot member 80, the opening 174 is configured at the lower portion thereof to form a guide opening 176 slidably receiving a slider member 178 biased upwardly by means of a coil spring 180 coacting with aligned projections 182 and 184 formed in the slider 178 and opening 176, respectively. The arrangements with respect to both sliders 176 and 178 is that with either foot member at its lowest position of travel (that is, in engagement with the fabric) the downward pressure of the respective foot results from the coil spring 150 or 180 respectively.

Referring again to FIG. 4 in conjunction with FIG. 5 the description of operation of the advance foot member 80 with respect to the pressure foot member 78 and the needle 92 will be discussed. As previously indicated, the cam surface 76 of FIG. 4 is in its proper phased relation with the cam surface 74 of FIG. 5 and the crank pin 82 is shown likewise in its phased relation in FIG. 4. As previously discussed, the position of crank pin 82 shown in FIG. 4 corresponds to the needle 92 being at its maximum height, that is fully withdrawn within cartridge 22. As cam member 68 rotates counterclockwise (in the direction indicated by the arrow) approximately one-third of a revolution the advance foot member 80 will rock to the right to the dotted line position with a corresponding movement of advance foot 98 to the left due to the rocking action about guide ribs 156; the needle 92 will commence its downward travel with crank pin 82 moving downwardly on a vertical line with needle 92 still within cartridge 22; and pressure foot member 78 will begin moving downwardly from the maximum solid line position shown in FIG. 5. This first one-third of a revolution increments the fabric from right to left as viewed in FIG. 4. During the next one-third revolution the advance foot member 80 will have completed its rocking to the right and will commence its upward travel by lifting advance foot 98 from the fabric while still canted to the right; pressure foot 96 will have completed it full downward travel to engage the fabric and needle 92 will have penetrated the fabric to form a stitch. During the next increment of rotation of cam member 68 the needle 92 will withdraw from the fabric while pressure foot 96 maintains its engagement with the surface of the fabric and advance foot member 80 after having rocked to the left dotted line position will commence its downward travel to re-engage the surface of the fabric. Pressure foot 96, during the movement of advance foot 98 downwardly to re-engage the fabric, is moving upwardly until the respective members are as shown in solid lines in FIGS. 4 and 5.

Figure 10:
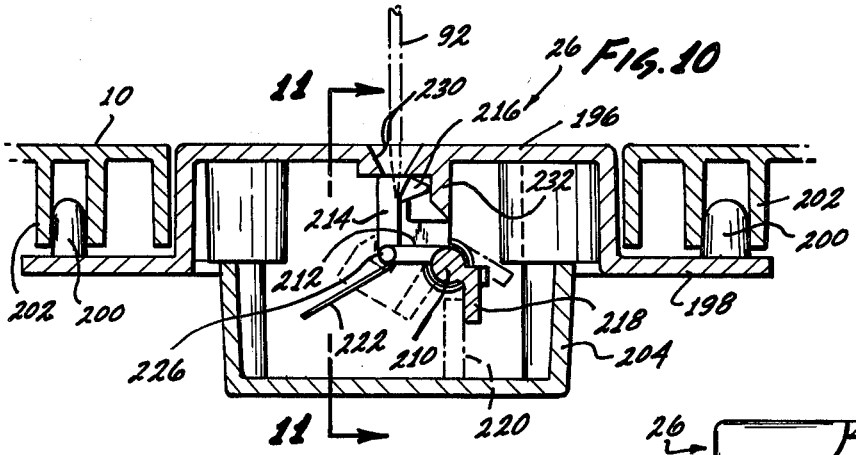
FIG. 10 is a cross-sectional end view of the thread looping subassembly used in the sewing machine of FIG. 1.
Figure 12:
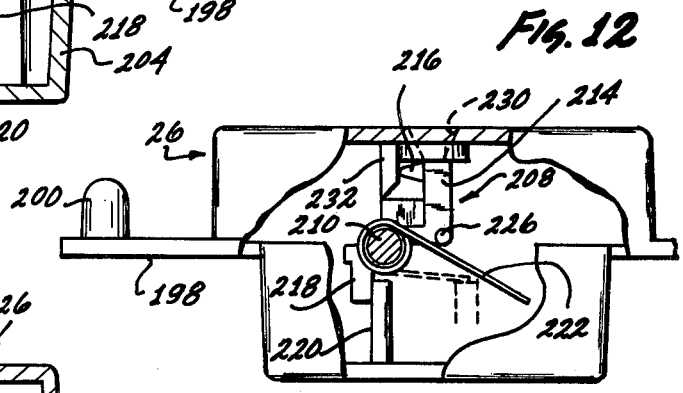
FIG. 12 is an end view, partially broken away, of the thread looping subassembly as viewed along line 12—12 of FIG. 11.
Figure 11:
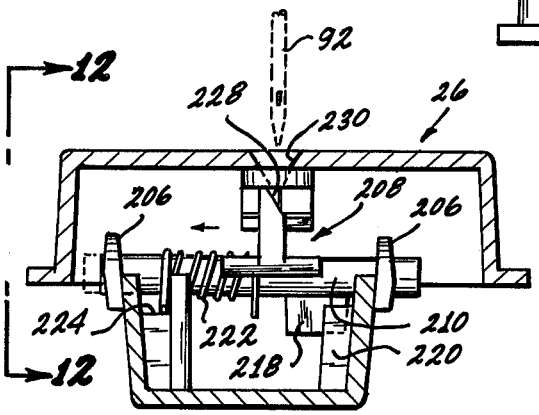
FIG. 11 is a cross-sectional rear view of the thread looping subassembly take along line 11—11 of FIG. 10.

Referring now to FIGS. 10–12 the details of construction of the thread looping subassembly or module 26 will be discussed. As shown in FIG. 10, the module 26 includes a first inverted generally cup-shaped housing portion 196 having a planar surface coextensive with the adjacent surface of bed 10, the housing portion 196 having a peripheral flange 198 with a plurality of upwardly extending projections 200 engaging downwardly depending bosses 202 formed in the undersurface of bed 10. A second housing portion 204 is suitably secured to the under side of housing portion 196, the housing portion 204 being generally cup-shaped and having formed integrally therein spaced aligned bearing apertures 206 for pivotally receiving the looper member generally designated 208, the looper member 208 being one-piece and having a shaft portion 210 pivotally engaging apertures 206 (see FIGS. 11 and 12). As shown in FIGS. 10 and 12 and referring to the solid line illustration of looper member 208, extending horizontally from shaft 210 is a plate portion 212 supporting a hook member 214 which is of inverted generally L-shaped configuration with a hook end thereof configured to form a hooked point 216 extending generally parallel to plate 212. Downwardly depending from shaft 210 is a stop tab 218 generally perpendicular to plate 212 and adapted to coact with a stop abutment 220 formed integrally in lower housing portion 204. The looper member 208 is normally biased in a clockwise direction as viewed in FIG. 10 by means of a coil bias spring 222 encircling a portion of shaft 206 between plate 212 and an adjacent surface of lower housing portion 204, one end of bias spring 222 resting in a detent 224 formed in the lower housing portion 204 with the other end being restrained by a projection 226 (see FIG. 12) extending outwardly from plate 212 in line therewith.

Referring to FIG. 11 the shaft 210 of looper member 208 is longer than the spacing between aperture 206, the shaft 210 being slidable axially to the left as viewed in the figure to the dotted line position. The hook member 214 as viewed in FIG. 11, has a tapered portion 228 adapted to be intercepted by the needle 92 descending through the aperture 230 in upper housing portion 196 during downward movement of needle 92. Upon contact of needle 92 with the tapered surface 228, the looper member 208 is initially displaced laterally to the left in the direction indicated by the arrow until shaft 210 extends to the dotted line position indicated. As shown in FIG. 10 the hook point 216 of hook member 214 in its normally biased position abuts against a downwardly depending tab 232 formed integrally with the undersurface of housing portion 196 in proximity to aperture 230. As the needle 92 continues its downward descent the point thereof engages plate 212 thereby pivoting looper member 208 in a counterclockwise direction to the dotted line position indicated against the force of bias spring 222. Consequently the action of needle 92 results in an initial lateral displacement of looper member 208 and then a pivoting thereof upon engagement of the point of needle 92 with the plate 212. Upon ascent of needle 92 the looper member 208 returns to the solid line position shown in FIG. 10 with the clockwise rotation thereof being under force of bias coil spring 222 until stop tap 218 abuts against stop abutment 220 and hook point 216 abuts against tab 232.

Figure 13:
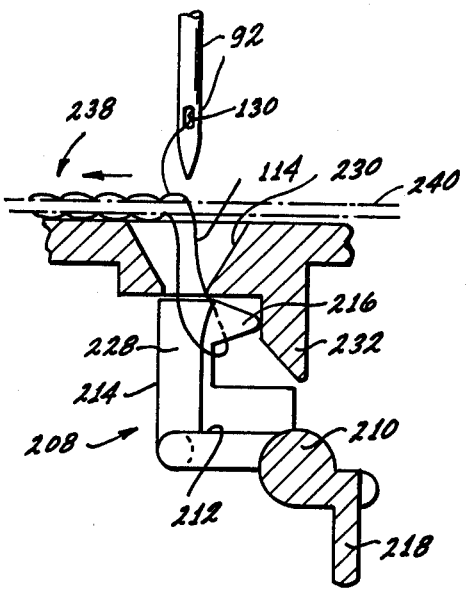
FIGS. 13–16 are enlarged end views of the thread looper coacting with the needle and thread sequentially illustrating the thread looping operation.
Figure 14:
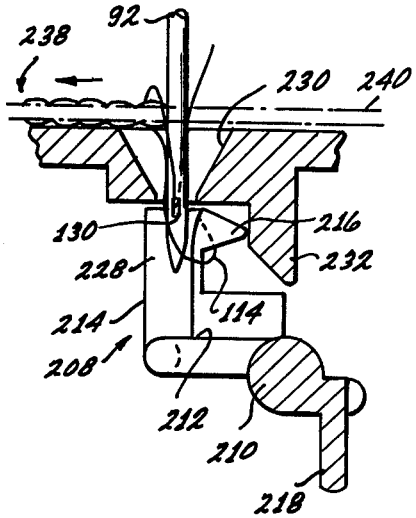
Figure 15:
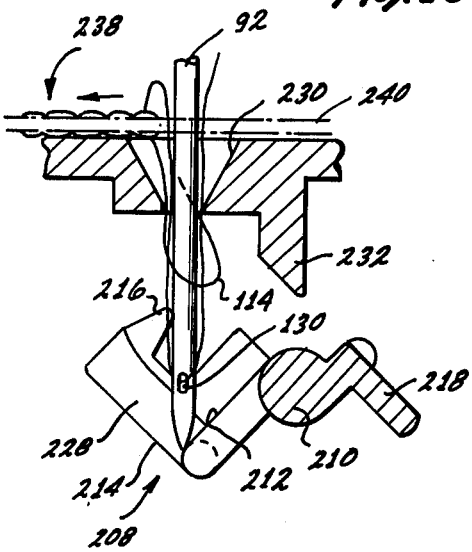
Figure 16:
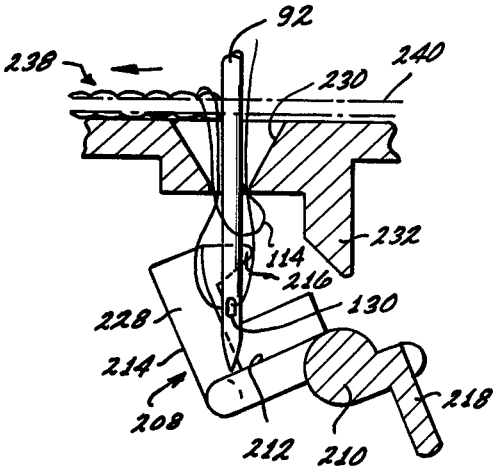

Referring now to FIGS. 13–16 the operation of the needle 92 carrying thread 114 with respect to the looper member 208 will be discussed. As previously mentioned, the sewing machine generates a chain stitch generally designated 238 through fabric 240 and by insertion of the thread through the fabric 240 by means of needle 92, retention of the thread 114 beneath the fabric to create a loop which is retained during withdrawal of the needle 92, movement of the fabric 240 (from right to left as viewed in the FIGURES), re-insertion of the needle with the thread carried thereby through the fabric and through the loop, and creation of a subsequent loop for repeating the process. As shown in FIG. 13 a loop of thread 114 has been retained about the hook point 216 which is abutting against tab 232. A portion of a chain stitch 238 has been generated in fabric 240 and the needle 92 is positioned above aperture 230 and on its downward descent for passage through fabric 240. The portion of hook member 214 to be first intercepted by the needle 92 after passage through the fabric 240 and through the aperture 230 is the tapered section 228 previously discussed with respect to FIG. 11. In FIG. 14, the initial action of needle 92 with the tapered surface 228 results in the looper member 208 being displaced laterally (that is, into the paper) thereby spreading the loop of thread 114 to permit the point of needle 92 to engage the loop. As the needle 92 continues its descent the point thereof engages plate 212 thereby pivoting looper member 208 counterclockwise (see FIG. 15) about shaft 210 thereof resulting in the release of the loop of thread 114 from engagement from hook point 216. The position depicted in FIG. 15 of looper member 208 is the maximum descent position of needle 92 during operation of the sewing machine. As the needle 92 ascends the hook point 216 slides against the adjacent surface above eye 130 thereof thereby engaging the thread 114 for retaining the thread 114 within the thread looping module 26 to thereby generate the next loop in the chain stitch 238. As the needle 92 ascends further the position thereof would correspond to that shown in FIG. 14 wherein the next link of the chain stitch 238 has been formed and a subsequent loop has been created. As the needle ascends out of engagement with the tapered surface 228 of hook 214 the looper member 208 then returns laterally (out of the paper) under force of coil bias spring 222 thereby spreading the loop so-formed for subsequent insertion of the needle 92 therethrough. Thus, utilizing only a single spool of thread and a very simple looper mechanism the sewing machine is capable of generating a chain stitch 238 for sewing fabric 240 in an efficient manner.

Summarizing the operation of the sewing machine the cartridge 22 as depicted in FIGS. 6 and 7 is a separate assembly containing a spool of thread 24, a needle carrier 94 having a needle 92 secured to the bottom thereof, the needle carrier 94 being adapted for sliding or reciprocating movement with cartridge 22. The overall length is such that with the needle carrier 94 normally biased upwardly the needle 92 is fully retracted within the cartridge 22. The thread 114 from the spool 24 is provided with appropriate thread tension by means of the tensioner created by passage of thread 114 through the eyelet over boss 118 and back through the eyelet to be received by the eye 130 of needle 92 thus providing a unitary cartridge assembly containing the thread, the tensioner and a pre-threaded needle.

The cartridge 22 is then inserted into the recess 20 formed in head 18 and is frictionally retained therein in any convenient fashion such as by providing suitable detents in the head 18, the surface 20 and the cartridge 22. Upon insertion of the cartridge 22 into the recessed surface 20 the crank pin 82 of cam member 68 is normally in the position shown in FIG. 4, the crank pin 82 engaging the crank pin groove 110 accessible through aperture 100 and formed in the rear surface of needle carrier 94. At this point, the switch disc 60 coacts with the switch arm 50 in the solid line position shown in FIG. 8. The operator then slides the advance foot lifter member 30 upwardly to lift the advance foot 98 out of contact with the upper surface of thread looping module 26 to insert the work thereunder. The fabric to be sewn is then placed in the desired position and advance foot lift member 30 is moved toward the operator thereby permitting advance foot 98 to engage the upper surface of the fabric (see FIG. 4). The switch lever 52 is then rotated by means of switch knob 28 to thereby electrically connect battery 44 to the motor 40 thereby rotating shaft 32 (see FIG. 2) along with cam member 68. Upon rotation of cam member 68 advance foot member 80, pressure foot member 78 and needle carrier 94 are reciprocated in timed sequence to perform the chain stitch operation described in conjunction with FIGS. 13–16. As previously discussed, the advance foot member is also laterally rocked under the influence of cam surface 76 to move the fabric toward the rear of the work bed 10 a predetermined distance indicative of the chain stitch length. When the operator desires to cease the operation of the sewing machine, the switch 28 is returned to its "off" position and the bent portion 58 of switch arm 50 continues to ride on the surface of switch disc 60 until the switch detent 62 (see FIG. 8) is in alignment for receiving the bent portion 58 therein resulting in the solid line position shown in FIG. 8, which as previously discussed would result in the crank pin 82 being at its uppermost position of travel with the needle 92 fully retracted within the cartridge 22.

By the utilization of the cartridge with the needle and needle carrier therein, especially in conjunction with the switching arrangement which precludes the motor being de-energized until the needle is fully retracted within the cartridge, a safe, efficient, relatively uncomplicated mechanism has been constructed to provide an electrically-operated chain stitch sewing machine utilizing a single spool of thread contained within the cartridge. Various cartridges can be supplied with various colors of thread to accomplish different desired sewing functions by the operator. While there has been shown and described a preferred embodiment, it is to be understood that various other adaptations and modifications may be made within the spirit and scope of the invention.

What is claimed is:

1. In a sewing machine, the combination comprising:

a housing having a bed and an overhanging bracket arm terminating in a head, said head having a recessed surface in a side thereof with said surface generally perpendicular to said bed;

a driving member rotatably mounted in said housing and having a portion thereof extending outwardly through an aperture in said recessed surface;

means within said housing for rotating said driving member;

a cartridge engaging said head within said recessed surface, said cartridge having a planar surface with an aperture therein in communication with said portion of said driving member;

a needle carrier slidably mounted on said planar surface within said cartridge for actuation by said driving member for reciprocating movement toward and away from said bed;

a needle secured to said needle carrier, said cartridge having an opening in alignment with said needle and in proximity to said bed for passage therethrough of said needle, said needle being substantially contained within said cartridge with said needle carrier at its maximum distance away from said bed; and looping means within said bed for coacting with said needle whereby to generate a stitch in material sewn on said sewing machine.

2. The combination according to claim 1 wherein said cartridge includes a spool of thread rotatably mounted therein with the thread passing through the eye of said needle and out through said opening, and said looping means are operable by said needle to generate a chain stitch.

3. The combination according to claim 2 wherein said driving member is a crank arm and said portion thereof is a crank pin.

4. The combination according to claim 3 wherein said cartridge further includes thread tensioning means for engaging said thread intermediate said spool and said opening.

5. The combination according to claim 4 wherein said needle carrier is normally biased within said cartridge with said needle fully retracted whereby to maintain said needle within said cartridge is removed from said machine.

6. The combination according to claim 5 wherein said means for rotating said crank arm includes an electrically operated motor and a switch, and said crank arm is provided with means for rendering the switch inoperative to deenergize the electrical motor until the needle is substantially contained within said cartridge.

7. The combination according to claim 6 wherein said switch has a stationary contact, a movable contact and a switch lever for urging said movable contact toward said stationary contact, and said means for rendering the switch inoperative includes a switch disc mounted on said crank arm, said switch disc having a detent, said switch disc coacting with said movable contact to maintain said movable contact in engagement with said stationary contact until said movable contact engages said detent.

8. The combination according to claim 7 wherein said movable contact has a portion thereof normally biased toward said switch disc, said portion being adapted to engage said detent.

9. In a cartridge for use in a sewing maching having a bed and an overhanging bracket arm terminating in a head having a recessed surface in the side thereof with a rotatable driving member engagable through an opening in said surface, said cartridge comprising:

a first member having a generally planar surface adapted to abut the recessed surface, said planar surface having an aperture therein in axial alignment with said driving member;

a needle carrier slidably mounted on said planar surface and having a portion adjacent said aperture engagable by said driving member for reciprocating said needle carrier with respect to said planar surface;

a needle secured to said needle carrier;

a cover secured to said first member to form a generally hollow housing so dimensioned substantially to contain said needle carrier and said needle therein;

an aperture within said housing in alignment with said needle for passage therethrough of said needle; and spring means within said housing coupled to said needle carrier normally urging said needle carrier in a direction with said needle fully retracted within said housing.

10. The combination according to claim 9 wherein said cartridge further includes means for rotatably receiving a spool of thread within said housing.

11. The combination according to claim 10 wherein said cartridge further includes tensioning means within said housing for engaging the thread from said spool.

12. The combination according to claim 11 wherein said cartridge further includes a spool of thread mounted on said spool receiving means, said thread engages said tensioning means and passes through the eye of the needle out through said aperture in alignment with said needle.

* * * * *